US009317011B2

(12) United States Patent
Mukataka

(10) Patent No.: US 9,317,011 B2
(45) Date of Patent: Apr. 19, 2016

(54) TONER COLLECTING DEVICE FOR IMAGE FORMING APPARATUS

(71) Applicant: KYOCERA Document Solutions Inc., Osaka-shi, Osaka (JP)

(72) Inventor: Hisashi Mukataka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/330,943

(22) Filed: Jul. 14, 2014

(65) Prior Publication Data

US 2015/0023686 A1 Jan. 22, 2015

(30) Foreign Application Priority Data

Jul. 17, 2013 (JP) ..... 2013-148373

(51) Int. Cl.
*G03G 21/00* (2006.01)
*G03G 21/20* (2006.01)
*G03G 21/10* (2006.01)

(52) U.S. Cl.
CPC ..... *G03G 21/206* (2013.01); *G03G 21/00* (2013.01); *G03G 21/10* (2013.01)

(58) Field of Classification Search
CPC ..... G03G 21/10; G03G 21/206; G03G 21/12; G03G 21/105
See application file for complete search history.

(56) References Cited

U.S. PATENT DOCUMENTS 5,150,135 A * 9/1992 Casey ..... G03G 15/0851 118/689
2008/0181688 A1* 7/2008 Kurita ..... G03G 15/2064 399/341
2011/0052246 A1* 3/2011 Kyung ..... G03G 21/206 399/92
2011/0103821 A1* 5/2011 Akiyama ..... G03G 21/206 399/93

FOREIGN PATENT DOCUMENTS

JP 04235575 A * 8/1992
JP 07020753 A 1/1995
JP 09311613 A * 12/1997
JP 2007298782 A * 11/2007

(Continued)

OTHER PUBLICATIONS

JP_2007298782_A_T Machine Translation.*

(Continued)

*Primary Examiner* — Clayton E Laballe
*Assistant Examiner* — Victor Verbitsky
(74) *Attorney, Agent, or Firm* — Alleman Hall McCoy Russell & Tuttle LLP

(57) ABSTRACT

An image forming apparatus is provided with an image forming portion, a collecting duct, a toner collecting device, a toner collecting device, and a first control portion. Into the collecting duct, unnecessary toner generated in the image forming portion flows together with an airflow. The toner collecting device communicates with the collecting duct, has a path of the airflow formed therein, and collects, by using a filter, the toner together with the airflow generated by an airflow generating portion. The first control portion controls an operation condition of a vibrating operation of a vibrating portion that vibrates the filter, in accordance with at least one of setting conditions relating to environment of the image forming portion, a coverage rate of a toner image, the number of printed sheets, and an image density of the toner image.

8 Claims, 9 Drawing Sheets

(56) References Cited

FOREIGN PATENT DOCUMENTS

| | | | |
|---|---|---|---|
| JP | 2008145826 | A * | 6/2008 |
| JP | 2011164643 | A | 8/2011 |

OTHER PUBLICATIONS

JP__2008145826__A__T Machine Translation.*
JP__09311613__A__T Machine Translation, Japan, Dec. 1997, Yamaguchi.*
JP__2007298782__A__T Machine Translation, Japan, Oct. 2007, Sata.*
JP__2008145826__A__T Machine Translation, Jpan, Jun. 2008,Azuma.*

* cited by examiner

TONER COLLECTING DEVICE FOR IMAGE FORMING APPARATUS

INCORPORATION BY REFERENCE

This application is based upon and claims the benefit of priority from the corresponding Japanese Patent Application No. 2013-148373 filed on Jul. 17, 2013, the entire contents of which are incorporated herein by reference.

BACKGROUND

The present disclosure relates to image forming apparatuses including toner collecting devices for collecting unnecessary toner.

An image forming apparatus utilizing electrophotography, such as a copying machine, a printer, a facsimile, or the like, forms a toner image on an image carrier (e.g., a photosensitive drum or a transfer belt) by supplying toner to an electrostatic latent image formed on the image carrier and developing the electrostatic latent image. The toner is stored in a developing device. The toner is supplied from a developing roller disposed in the developing device to the image carrier.

Of the toner stored in the developing device, low-charged toner is likely to scatter around the developing device. The scattered toner may contaminate the inside and the outside of a main body of the image forming apparatus. For example, a technique of collecting such scattered toner from an image forming station including the image carrier via an exhaust duct, has been known.

SUMMARY

An image forming apparatus according to an aspect of the present disclosure includes an image forming portion, a collecting duct, a toner collecting device, and a first control portion. The image forming portion executes a printing operation of forming a toner image on a sheet. Into the collecting duct, unnecessary toner generated inside or around the image forming portion flows together with an airflow. The toner collecting device communicates with the collecting duct, has a path of the airflow formed therein, and collects the toner together with the airflow. The collecting device includes a filter, an airflow generating portion, and a vibrating portion. The filter collects the toner and lets the airflow pass therethrough. The airflow generating portion is disposed downstream of the filter in the path of the airflow, and executes an intake operation of generating the airflow. The vibrating portion executes a vibrating operation of vibrating the filter. The first control portion controls an operation condition of the vibrating operation, in accordance with at least one of setting conditions including: a first condition relating to environment inside or around the image forming portion; a second condition relating to a coverage rate of the toner image formed on the sheet; a third condition relating to the number of printed sheets; and a fourth condition relating to an image density of the toner image.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
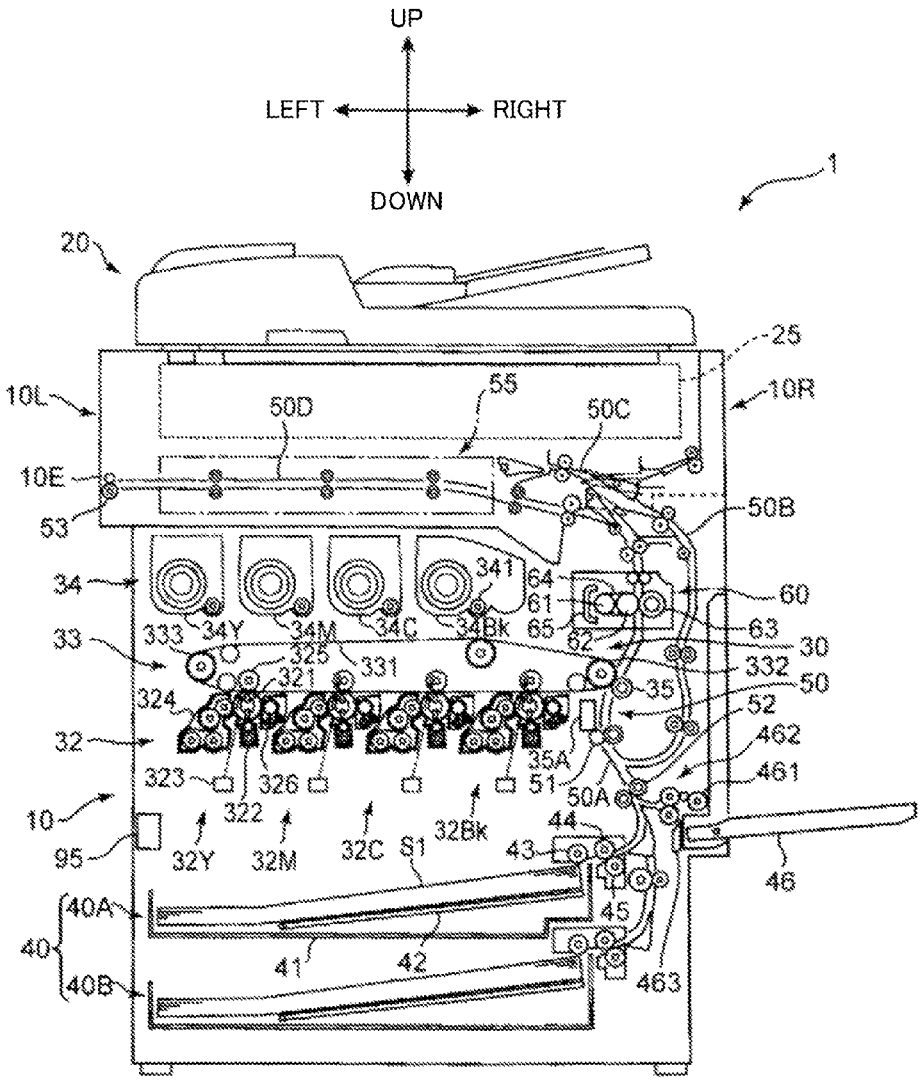
FIG. 1 is a cross-sectional view showing an internal structure of an image forming apparatus according to an embodiment of the present disclosure.

Hereinafter, embodiments of the present disclosure will be described in detail based on the drawings. FIG. 1 is a cross-sectional view showing an internal structure of an image forming apparatus 1 according to an embodiment of the present disclosure. In the description herein, a full-color multifunction peripheral having a printing function and a copying function is illustrated as the image forming apparatus 1. However, the image forming apparatus may be a printer, a copy machine, or a facsimile apparatus. In addition, the image forming apparatus may be a monochrome apparatus.

<Description of Image Forming Apparatus>

The image forming apparatus 1 includes an apparatus body 10 that is structured as a housing having a substantially rectangular parallelepiped shape, and an automatic document feeder 20 disposed on the apparatus body 10. In the apparatus body 10, a reading unit 25, an image forming portion 30, a fixing portion 60, a sheet feed portion (sheet storage portion) 40, a conveying path 50, a conveying unit 55 and the like are accommodated. The reading unit 25 optically reads a document image to be copied. The image forming portion 30 forms a toner image on a sheet. The fixing portion 60 fixes the toner image onto the sheet. The sheet feed portion (sheet storage portion) 40 stores sheets to be conveyed to the image forming portion 30. The conveying path 50 is extended such that a sheet is conveyed from the sheet feed portion 40 or a sheet feed tray 46 to a sheet discharge outlet 10E through the image forming portion 30 and the fixing portion 60. The conveying unit 55 forms a part of the conveying path 50, and conveys a sheet.

The image forming portion 30 executes an image forming operation (printing operation) to form a full-color toner image on a sheet. The image forming portion 30 includes an image forming unit 32, an intermediate transfer unit 33, and a toner supply portion 34. The image forming unit 32 includes four image forming units 32Y, 32M, 32C, and 32Bk arranged in a tandem manner. The image forming unit 32Y forms a toner image in yellow (Y). The image forming unit 32M forms a toner image in magenta (M). The image forming unit 32C forms a toner image in cyan (C). The image forming unit 32Bk forms a toner image in black (Bk). The intermediate transfer unit 33 is disposed on and adjacent to the image forming unit 32. The toner supply portion 34 is disposed above the intermediate transfer unit 33.

Each of the image forming units 32Y, 32M, 32C, and 32Bk includes a photosensitive drum 321 (an example of an image carrier). In addition, a charging unit 322, an exposure unit 323, a developing device 324, a primary transfer roller 325, and a cleaning device 326 are disposed around the photosensitive drum 321.

The photosensitive drum 321 rotates around its axis, and carries an electrostatic latent image and a toner image on a circumferential surface thereof. As the photosensitive drum 321, a photosensitive drum formed of an amorphous-silicon-(a-Si)-based material may be used. The charging unit 322 uniformly charges the surface of the photosensitive drum 321. The exposure unit 323 includes optical devices such as a laser light source, a mirror, a lens, and the like. The exposure unit 323 irradiates the circumferential surface of the photosensitive drum 321 with light based on image data of a document image to form an electrostatic latent image. The photosensitive drum 321 acts as an image carrier.

The developing device 324 stores toner therein, and supplies the toner to the circumferential surface of the photosensitive drum 321 to develop the electrostatic latent image formed on the photosensitive drum 321. The developing device 324 uses a two-component developer, and includes a screw feeder, a magnetic roller, and a developing roller. As shown in FIG. 1, the developing devices 324 corresponding to the respective colors are arranged adjacent to each other in the horizontal direction (left-right direction).

The primary transfer roller 325 forms, together with the photosensitive drum 321, a nip portion via an intermediate transfer belt 331 included in the intermediate transfer unit 33, and primarily transfers a toner image on the photosensitive drum 321 onto the intermediate transfer belt 331. The cleaning device 326 includes a cleaning roller and the like, and cleans the circumferential surface of the photosensitive drum 321 after the toner image transfer.

The intermediate transfer unit 33 includes the intermediate transfer belt 331, a drive roller 332, and a follower roller 333. The intermediate transfer belt 331 is an endless belt that extends on and between the driving roller 332 and the follower roller 333. Onto the same portion of an outer circumferential surface of the intermediate transfer belt 331, toner images are transferred from a plurality of photosensitive drums 321 so as to be superimposed on each other. The intermediate transfer belt 331 is rotated counterclockwise in FIG. 1. The intermediate transfer belt 331 acts as an image carrier.

A secondary transfer roller (transfer portion) 35 is disposed so as to face the circumferential surface of the driving roller 332. The secondary transfer roller 35 transfers the toner image from the intermediate transfer belt 331 onto a sheet. A nip portion formed between the drive roller 332 and the secondary transfer roller 35 acts as a secondary transfer portion that transfers, onto a sheet, a full-color toner image obtained on the intermediate transfer belt 331 by images being superimposed on each other. A secondary transfer bias voltage having a polarity opposite to that of the toner image is applied to one of the driving roller 332 and the secondary transfer roller 35, while the other roller is grounded. In addition, a density sensor 35A is disposed upstream of the drive roller 332 in the rotation direction of the intermediate transfer belt 331. The density sensor 35A is disposed so as to face the circumferential surface of the intermediate transfer belt 331. The density sensor 35A outputs an electric signal in accordance with the density of the toner image formed on the intermediate transfer belt 331.

The toner supply portion 34 includes a yellow-toner container 34Y, a magenta-toner container 34M, a cyan-toner container 34C, and a black-toner container 34Bk. The toner containers 34Y, 34C, 34M, and 34Bk store toners of the respective colors. The toner containers 34Y, 34C, 34M, and 34Bk supply the toners of the respective colors through not-illustrated supply paths to the developing devices 324 of the corresponding image forming units 32Y, 32C, 32M, and 32Bk, respectively.

The sheet feed portion 40 includes two sheet feed cassettes 40A and 40B in which sheets to be subjected to an image forming process are stored. These sheet feed cassettes 40A and 40B can be drawn forward from the front of the apparatus body 10. The sheet feed portion 40 stores sheets to be conveyed toward the secondary transfer roller 35. The sheet feed portion 40 is disposed beneath the above-described developing device 324.

The fixing portion 60 is an induction heating type fixing device that performs a fixing process for fixing a toner image onto a sheet. The fixing portion 60 includes a heating roller 61, a fixing roller 62, a pressure roller 63, a fixing belt 64, and an induction heating unit 65. The pressure roller 63 is pressed against the fixing roller 62 to form a fixing nip portion. The heating roller 61 and the fixing belt 64 are induction-heated by the induction heating unit 65, and the heat is applied to the fixing nip portion. By the sheet passing through the fixing nip portion, a toner image having been transferred to the sheet is fixed onto the sheet.

Figure 2:
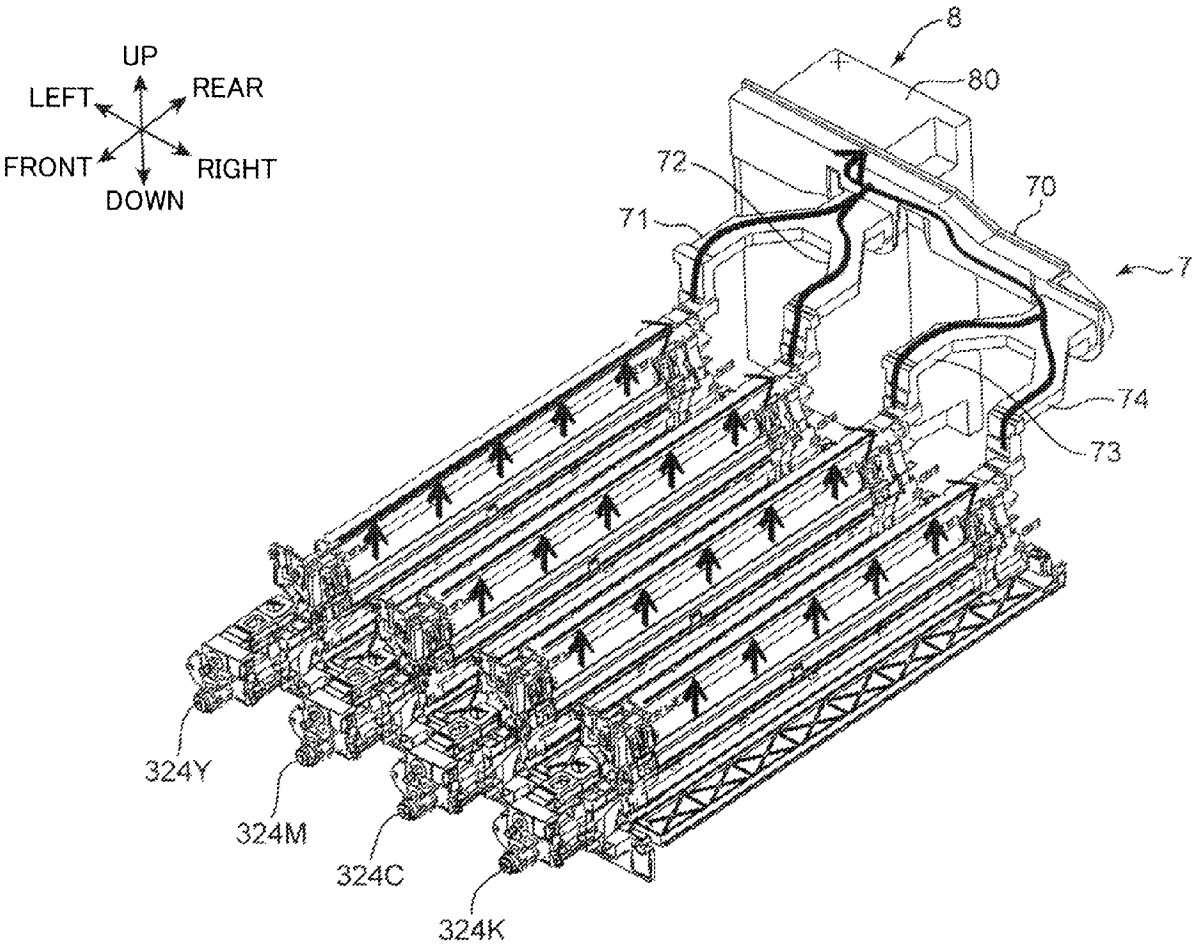
FIG. 2 is a perspective view showing a developing device, a collecting duct, and a toner collecting device according to the embodiment of the present disclosure.
Figure 3:
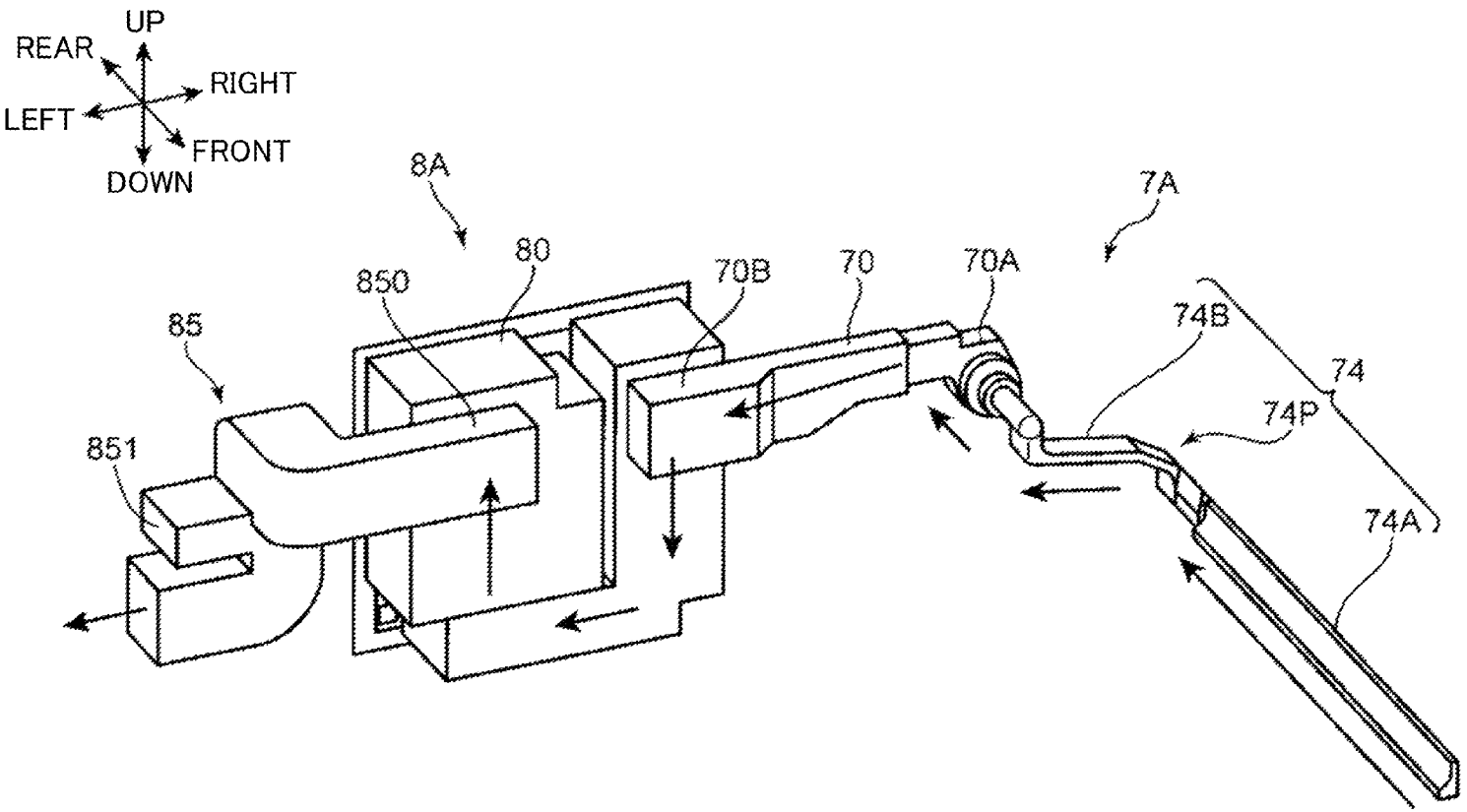
FIG. 3 is a perspective view showing a collecting duct and a toner collecting device according to another embodiment of the present disclosure.

The image forming apparatus 1 further includes a collecting duct 7 and a toner collecting unit 8 (an example of a toner collecting device). FIG. 2 is a perspective view showing the developing device 324, the collecting duct 7, and the toner collecting unit 8 according to the present embodiment. FIG. 3 is a perspective view showing a part of a collecting duct 7A and a toner collecting unit 8A which are mounted to a not-illustrated monochrome multifunction peripheral (an example of an image forming apparatus) according to another embodiment of the present disclosure.

With reference to FIG. 2, the collecting duct 7 is disposed at the rear side of the developing devices 324 (324Y, 324M, 324C, and 324Bk) for the respective colors, which are arranged adjacent to each other. The collecting duct 7 collects, together with airflow, scattered toner (an example of unnecessary toner) generated inside each developing device 324 of the image forming portion 30, and causes the toner to flow into an inlet 800 of the later-described toner collecting unit 8. The collecting duct 7 conveys the toner from the developing device 324 in the substantially horizontal direction. In another embodiment, the collecting duct 7 may be a duct that collects toner scattered around each developing device 324 or toner scattered around another part of the image forming portion 30. The collecting duct 7 includes a main duct 70, a yellow duct 71, a magenta duct 72, a cyan duct 73, and a black duct 74. The main duct 70 is a duct extended in the left-right direction at the rear side of the developing devices 324. In the main duct 70, exhaust air paths are disposed, through which toners collected from the developing devices 324 for the respective colors are conveyed. The toners collected from inside the developing devices 324 for the respective colors flow into the yellow duct 71, the magenta duct 72, the cyan duct 73, and the black duct 74 together with airflow. Further, these ducts cause the toners and the air to flow into the exhaust air paths of the main duct 70. Thus, in the present embodiment, the scattered toner (an example of unnecessary toner) is directly collected from the inside of each developing device 324. As a result, inner contamination around the image forming portion 30 can be reliably prevented. Further, as compared to a case of collecting scattered toner together with airflow from a region in the vicinity of the charging unit 322, ozone destruction of a later-described first filter 811 or the like is prevented.

With reference to FIG. 3, the black duct 74 of the collecting duct 7A includes a housing duct 74A, a bent duct portion 74B, and a curved portion 74P.

The housing duct 74A is a duct portion connected to an upper portion of a not-illustrated developing device for black of the monochrome multifunction peripheral. The housing duct 74A is extended in the front-rear direction, and communicates with the inside of the developing device. With rotation of a later-described fan 83 (refer to FIG. 4) of the toner collecting unit 8A, scattered toner inside the developing device flows into the housing duct 74A together with airflow. The bent duct portion 74B is a duct portion connected to a rear end portion of the housing duct 74A. As shown in FIG. 3, the bent duct portion 74B is extended upward and leftward from the rear end portion of the housing duct 74A and then bent rearward. The curved portion 74P is a curved duct portion through which the housing duct 74A and the bent duct portion 74B communicate with each other.

The main duct 70 further includes a main duct inlet portion 70A and a main duct exhaust portion 70B.

The main duct inlet portion 70A is disposed at a right end portion of the main duct 70. The main duct inlet portion 70A is connected to a rear end portion of the bent duct portion 74B. The air flowing from the housing duct 74A into the bent duct portion 74B flows through the main duct inlet portion 70A into the main duct 70. The main duct exhaust portion 70B is disposed at a left end portion of the main duct 70. The air flowing into the main duct 70 flows through the main duct exhaust portion 70B and an inlet 800 of a later-described housing 80 into the housing 80.

With reference to FIG. 3, the toner collecting unit 8A is connected to the left end portion of the main duct 70. The toner collecting unit 8A includes the housing 80 and an exhaust portion 85. The exhaust portion 85 includes an exhaust inlet portion 850 and an exhaust filter 851. The housing 80 communicates with the collecting duct 7, and has a function of finally collecting scattered toner collected from the developing device together with airflow. Therefore, in the housing 80, a path of airflow is formed. In the path of airflow, the exhaust portion 85 is disposed downstream of the housing 80. The exhaust portion 85 has a function of exhausting the airflow to the outside of the image forming apparatus. The exhaust portion 85 includes an exhaust inlet portion 850 and an exhaust filter 851. The airflow circulating inside the housing 80 flows through the exhaust inlet portion 850 into the exhaust portion 85. The exhaust filter 851 is a filter disposed in the path of airflow in the exhaust portion 85. The exhaust filter 851 collects dust, dirt, and slightly remaining toner from the airflow exhausted from the exhaust portion 85 to the outside of the image forming apparatus.

<Configuration of Housing 80>

Figure 4:
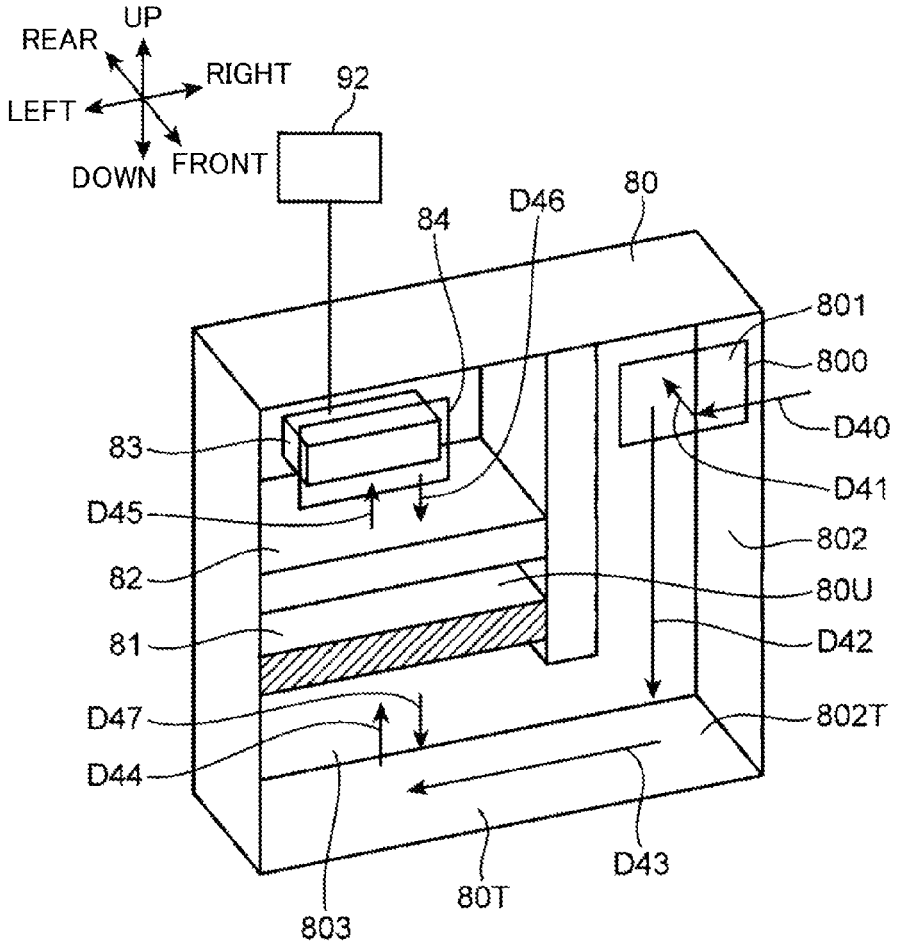
FIG. 4 is a perspective view showing the inside of the toner collecting device according to the embodiment of the present disclosure.
Figure 5:
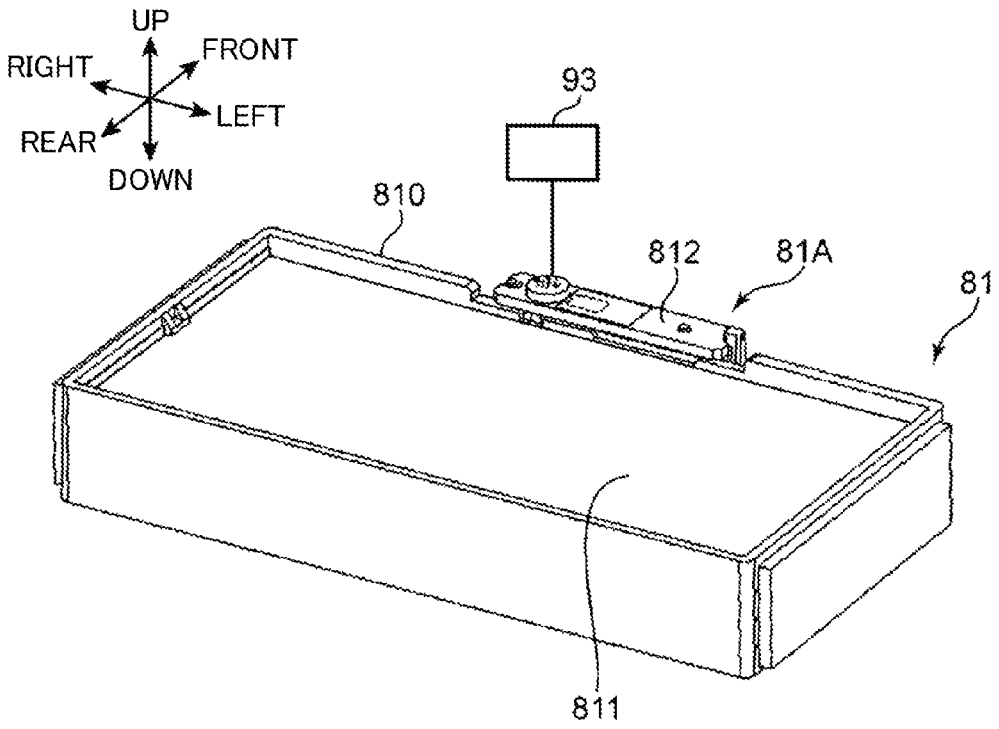
FIG. 5 is a perspective view showing a first filter according to the embodiment of the present disclosure.

Hereinafter, the configuration of the housing 80 included in the toner collecting units 8 and 8A will be described with reference to FIGS. 4 and 5. Since the toner collecting units 8 and 8A shown in FIGS. 2 and 3 include the housings 80 of the same configuration, the configuration of the housing 80 shown in FIG. 3 will be described hereinafter. FIG. 4 is a perspective view showing the inside of the housing 80. FIG. 5 is a perspective view showing a first filter portion 81 in the housing 80.

With reference to FIG. 4, the toner collecting unit 8 (8A) includes the housing 80, the first filter portion 81 (an example of a filter), a second filter portion 82, the fan 83 (an example of an airflow generating portion), and a housing exhaust port 84.

The housing 80 has a substantially rectangular parallelepiped shape. The housing 80 is disposed beneath the main duct 70. The housing 80 and the exhaust portion 85 define the outer shape of the toner collecting unit 8. The housing 80 houses therein the first filter portion 81, the second filter portion 82, and the fan 83. Further, in the housing 80, a plurality of duct portions through which airflow is guided are disposed. The duct portions function as the path of airflow. The housing 80 includes the inlet 800, an upper duct 801, a duct fall portion 802, a duct rise portion 80U, and a bottom portion 80T. The bottom portion 80T is a bottom portion of the housing 80, and defines a bottom surface of a later-described lower duct 803. In addition, the housing 80 supports the first filter portion 81, the second filter portion 82, and the fan 83.

The inlet 800 is opened in the housing 80, and toner flows through the inlet 800 into the housing 80 together with airflow. The inlet 800 communicates with the main duct 70. The inlet 800 is an opening that is opened frontward at an upper-right end portion of a front surface of the housing 80. Air that contains scattered toner flows from the main duct exhaust portion 70B of the main duct 70 through the inlet 800 into the housing 80.

The upper duct 801 is a space formed at the upper-right end portion of the housing 80. The upper duct 801 is disposed facing the inlet 800. In addition, the upper duct 801 communicates with the duct fall portion 802.

The duct fall portion 802 communicates with a lower end portion of the upper duct 801. That is, in the housing 80, the duct fall portion 802 is disposed so as to communicate with the inlet 800 through the upper duct 801. The duct fall portion 802 guides the airflow downward to the bottom portion 80T of the housing 80. The duct fall portion 802 is a duct portion extended in the up-down direction in the right end portion of the housing 80.

In the housing 80, the duct rise portion 80U is disposed adjacent to the duct fall portion 802 in the horizontal direction. The duct rise portion 80U communicates with the duct fall portion 802 on the bottom portion 80T side, and guides the airflow upward. The duct rise portion 80U is extended in the up-down direction from the bottom portion 80T to a region where the fan 83 is disposed. The duct rise portion 80U includes the lower duct 803 (an example of a guiding duct portion). The lower duct 803 is disposed between the inlet 800 and the fan 83 in the path of airflow. The lower duct 803 guides the airflow from a lower portion thereof to an upper portion thereof. The lower duct 803 is disposed in a lower portion of the duct rise portion 80U. Further, as described above, the bottom portion 80T is disposed beneath the lower duct 803, and defines the bottom surface of the lower duct 803. On the bottom portion 80T, toner that has fallen by gravity from the first filter 811 due to vibration of a later-described vibrating portion 81A is accumulated.

The duct fall portion 802 and the lower duct 803 of the duct rise portion 80U communicate with each other via an introducing portion 802T. In other words, the introducing portion 802T causes the air flowing through the inlet 800 to flow into the lower duct 803 from a side portion (right-side portion) of the lower duct 803.

In the housing 80, the first filter portion 81 is disposed upstream of the fan 83 in the path of airflow. In addition, the first filter portion 81 is disposed above the lower duct 803 such that a surface thereof on which airflow enters faces downward. The first filter portion 81 collects the toner flowing through the inlet 800 together with airflow, and allows the airflow to pass therethrough. The first filter portion 81 is disposed in the lower portion of the duct rise portion 80U. The first filter portion 81 has a shape of a rectangular parallelepiped having a predetermined thickness in the up-down direction.

The second filter portion 82 is disposed between the fan 83 and the first filter portion 81 in the path of airflow. The second filter portion 82 collects the toner that has not been collected by the first filter portion 81, and allows airflow to pass therethrough. The second filter portion 82 has a shape of a rectangular parallelepiped having a predetermined thickness in the up-down direction.

The fan 83 (an example of an airflow generating portion) is disposed inside the housing 80. The fan 83 intakes airflow coming from the inlet 800, and discharges the airflow to the outside of the housing 80. The fan 83 discharges, forward, airflow coming from the lower side. The fan 83 is disposed in an upper portion of the duct rise portion 80U. In other words, the fan 83 is disposed downstream of the first filter portion 81 and the second filter portion 82 in the path of airflow. The fan 83 is rotated by a later-described fan control portion 92, and executes an air intake operation that generates airflow traveling from the inlet 800 toward the first filter portion 81.

The housing exhaust port 84 is an opening opened at the front surface of the housing 80 so as to face the fan 83. The air exhausted from the fan 83 flows through the housing exhaust port 84 into the exhaust portion 85.

With reference to FIG. 5, the first filter portion 81 includes the vibrating portion 81A and the first filter 811. The vibrating portion 81A includes a frame 810 and a vibration motor 812. The vibrating portion 81A executes a vibrating operation for vibrating the first filter 811. The frame 810 is supported by the housing 80 and holds the first filter 811 therein. The frame 810 is disposed so as to surround four surfaces, facing each other in the horizontal direction, of the first filter 811. A known filter for dust can be adopted as the first filter 811. In the present embodiment, the first filter 811 includes a not-illustrated filter paper having a predetermined density. The filter paper is formed of glass fibers each having a diameter of 1 to 10 μm. The filling percentage of the glass fibers is about 10%, and the inter-fiber gap is set to 10 to 50 μm. The vibration motor 812 is fixed to an upper end portion of a front-side side wall of the frame 810, and vibrates the first filter 811 via the frame 810. The vibration motor 812 includes a not-illustrated weight that is eccentrically disposed at a front end of a not-illustrated rotation shaft. As the weight rotates, rotation vibration occurs from the vibration motor 812.

Likewise, the second filter portion 82 is also formed by surrounding a not-illustrated second filter with a not-illustrated frame. In addition, as the second filter and the exhaust filter 851 (FIG. 3), filters for dust similar to that of the first filter 811 are adopted.

Vibrating the first filter 811 with the vibrating portion 81A prevents the first filter 811 from being clogged with toner. In the present embodiment, as described above, a plurality of filters are disposed along the path of airflow in the housing 80 and the exhaust portion 85. The vibrating portion 81A vibrates, among the plurality of filters, the first filter 811 located closest to the inlet 800 in the path of airflow in the housing 80. Since the first filter 811 that collects the toner the most among the plurality of filters is vibrated, clogging of the first filter 811 is prevented, and collecting performance of the toner collecting unit 8 is stably maintained.

Figure 6:
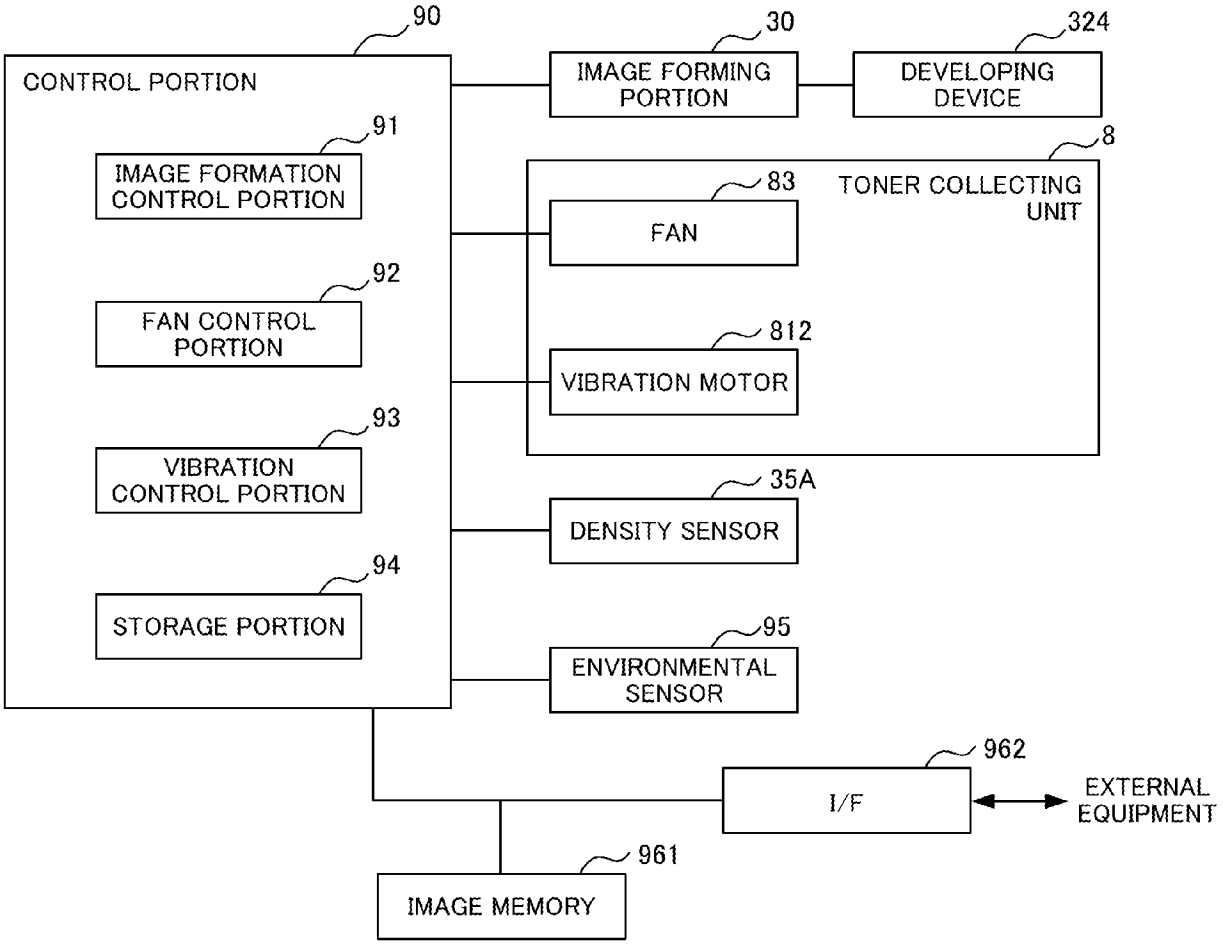
FIG. 6 is an electric block diagram showing a control portion according to the embodiment of the present disclosure.

Next, an electrical configuration of the image forming apparatus 1 will be described. FIG. 6 is an electrical block diagram of a control portion 90 included in the image forming apparatus 1 according to the present embodiment. The control portion 90 includes a CPU (Central Processing Unit), a ROM (Read Only Memory) storing a control program, a RAM (Random Access Memory) used as a work area of the CPU, and the like. The image forming portion 30 including the developing device 324, the fan 83, the vibration motor 812, and the density sensor 35A are electrically connected to the control portion 90. In addition, an environmental sensor 95 (FIG. 1, FIG. 6), an image memory 961, and an I/F 962 (FIG. 6) are electrically connected to the control portion 90. The monochrome multifunction peripheral according to the other embodiment described above also includes the same electrical configuration as above.

In the apparatus body 10, the environmental sensor 95 is disposed beneath the image forming portion 30. The environmental sensor 95 detects a temperature and a relative humidity around the image forming portion 30.

When the image forming apparatus 1 acts as a printer, the image memory 961 temporarily stores therein printing image data supplied from external equipment such as a personal computer, for example. When the image forming apparatus 1 acts as a copying machine, the image memory 961 temporarily stores therein image data optically read by the reading unit 25.

The I/F 962 is an interface circuit for realizing data communication with external equipment. For example, the I/F 962 forms a communication signal based on a communication protocol of a network connecting the image forming apparatus 1 with external equipment, and converts a communication signal provided from the network into data in a format that the image forming apparatus 1 can process. A printing instruction signal transmitted from a personal computer or the like is provided to the control portion 90 via the I/F 962. In addition, the image data is stored in the image memory 961 via the I/F 962.

When the CPU executes the control program stored in the ROM, the control portion 90 acts as an image formation control portion 91, a fan control portion 92 (an example of a second control portion), a vibration control portion 93 (an example of a first control portion), and a storage portion 94.

The image formation control portion 91 controls not-illustrated drive means to drive-control the components of the image forming portion 30 based on later-described timings. In addition, the image formation control portion 91 controls a not-illustrated bias applying portion to apply a predetermined bias voltage to the components of the image forming portion 30.

The fan control portion 92 controls the air intake operation of the fan 83. In the present embodiment, the fan control portion 92 causes the fan 83 to execute the air intake operation by rotationally driving the fan 83, in response to a printing operation time during which the printing operation is executed in the image forming portion 30. Thereby, unnecessary toner is stably collected. In addition, the fan control portion 92 stops the air intake operation, in response to a non-printing operation time during which no printing operation is executed in the image forming portion 30. In another embodiment, the fan control portion 92 may reduce the number of rotations of the fan 83 during the non-printing operation time to reduce the volume of airflow generated by the fan 83, as compared with the printing operation time. Thereby, the toner separated from the first filter 811 is prevented from being taken by the fan 83.

The vibration control portion 93 controls the vibrating operation of the vibrating portion 81A. Specifically, the vibration control portion 93 causes the vibrating portion 81A to execute the vibrating operation during the non-printing operation time when no printing operation is executed in the image forming portion 30. In addition, the vibration control portion 93 stops the vibrating operation of the vibrating portion 81A during the printing operation time when the printing operation is executed in the image forming portion 30. In addition, the vibration control portion 93 controls an operation condition of the vibrating operation of the vibrating portion 81A in accordance with later-described setting conditions.

The storage portion 94 stores therein information of the setting conditions for execution of the vibrating operation of the vibrating portion 81A. In addition, the storage portion 94 stores therein information of the operation condition of the vibrating operation of the vibrating portion 81A. The setting conditions (examples of first to fourth conditions) and the operation condition will be described later in detail.

By the way, when scattered toner is collected from an image forming station including an image carrier via an exhaust duct, if usage conditions of the image forming station vary and thereby the scattered toner increases, the performance of collecting the scattered toner is reduced, which may cause clogging of the toner at the exhaust duct. In contrast, in the image forming apparatus 1, even when the amount of unnecessary toner collected from the image forming portion 30 varies, the performance of collecting the toner is stably maintained.

Figure 7:
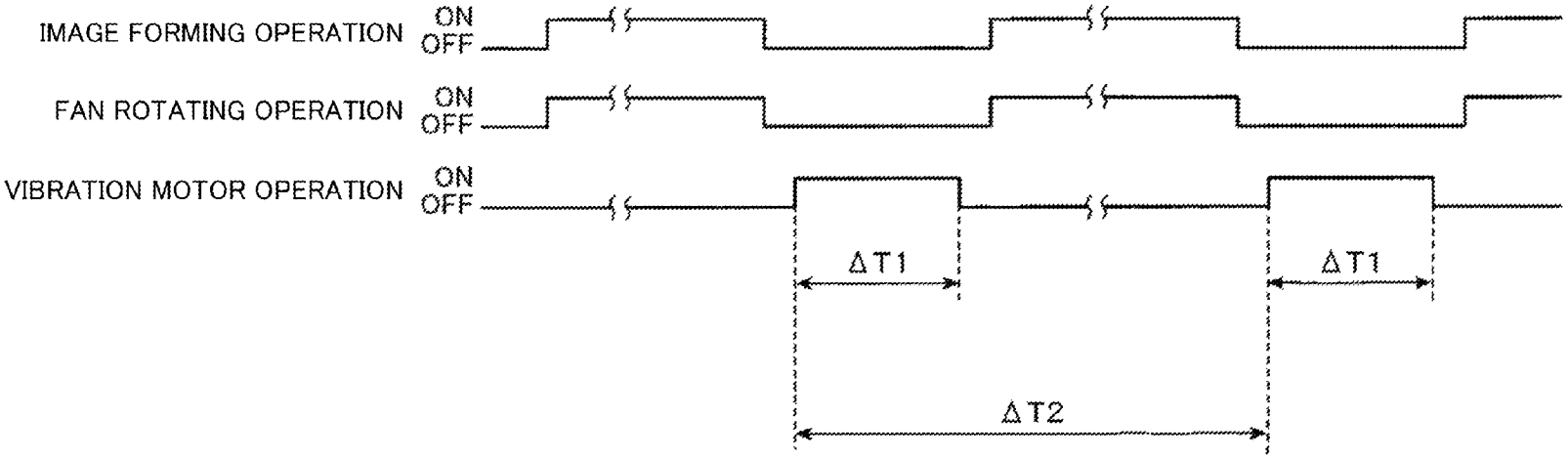
FIG. 7 is a timing chart showing a vibrating operation of a vibration motor and an air intake operation of a fan according to the embodiment of the present disclosure.

Next, airflow and flow of toner in the vicinity of the toner collecting unit 8 will be described. FIG. 7 is a timing chart showing operation timings of the image forming operation (an example of a printing operation) in the image forming portion 30 of the image forming apparatus 1, the air intake operation (rotating operation) of the fan 83, and the vibrating operation of the vibrating portion 81A.

After the image forming apparatus 1 is powered on, when the printing operation (image forming operation) to sheets is started, a developing roller and a screw (both not shown) of the developing device 324 are rotated in accordance with an instruction from the image formation control portion 91. At this time, the fan control portion 92 causes the fan 83 to rotate forward and execute the air intake operation. As a result, air that contains toner flows from the developing device 324 through the collecting duct 7 into the toner collecting unit 8. The air (shown by arrows D40 and D41 in FIG. 4) flowing from the inlet 800 into the housing 80 flows through the upper duct 801 into the duct fall portion 802. The air is temporarily caused to fall in the duct fall portion 802 (shown by an arrow D42 in FIG. 4), and then flows through the introducing portion 802T into the lower duct 803 from a side portion of the lower duct 803 (shown by an arrow D43 in FIG. 4). The lower duct 803 guides the airflow from the lower portion thereof to the upper portion thereof (shown by an arrow D44 in FIG. 4). When the air passes through the first filter 811 of the first filter portion 81 disposed above the lower duct 803, the toner is collected by the first filter 811. In addition, the air having passed through the first filter 811 passes through the second filter portion 82. At this time, the toner that has not been collected by the first filter 811 is collected by the second filter portion 82.

The air having passed through the second filter portion 82 flows into the fan 83 (shown by an arrow D45 in FIG. 4). Then, the air is discharged forward by the fan 83. Thereafter, the air flows into the exhaust portion 85 (FIG. 3), passes through the exhaust filter 851, and is discharged to the outside of the toner collecting unit 8 (image forming apparatus 1) (refer to arrows in FIG. 3). The operation of collecting the scattered toner and discharging the air, based on the rotation of the fan 83, is performed over the printing operation of the image forming apparatus 1 (refer to FIG. 7).

As described above, in the present embodiment, the toner having flowed into the housing 80 together with the airflow is collected by the first filter portion 81 disposed upstream of the fan 83. Further, on the path of airflow, the second filter portion 82 and the exhaust filter 851 are disposed upstream and downstream of the fan 83, respectively. Therefore, the toner is reliably collected, and is prevented from being discharged to the outside of the toner collecting unit 8. Accordingly, inside or outside the image forming apparatus 1, contamination due to the scattered toner is preferably prevented.

With the use of the toner collecting unit 8, a large amount of toner is collected by the first filter 811 of the first filter portion 81 disposed on the most upstream side in the path of airflow. If the first filter 811 is clogged, the airflow is blocked, and the toner collecting performance is degraded. Therefore, in the present embodiment, the vibration control portion 93 drives the vibration motor 812. Specifically, as shown in FIG. 7, the vibration control portion 93 drives the vibration motor 812 after the printing operation of the image forming apparatus 1.

If the fan 83 is rotated forward during driving of the vibration motor 812, the toner floating up from the upper surface of the first filter 811 due to vibration of the vibration motor 812 might be taken by the fan 83. This disadvantage is avoided by executing the forward rotating operation of the fan 83 and the driving operation of the vibration motor 812 at different timings. In another embodiment, when the vibration motor 812 executes the vibrating operation, the fan 83 may be rotated at such a low speed that the floating toner is not taken by the fan 83. At this time, in order to prevent the toner from floating from the first filter 811, the vibrating operation is preferably executed in the state where the volume of airflow generated by the fan 83 is less likely to vary. In particular, preferably, the variation in the volume of airflow is not greater than 10%, and more preferably, not greater than 5%. In other words, it is desirable that the vibrating operation of the vibrating portion 81A is started when rotation of the fan 83 due to inertia is completely stopped after the fan control portion 92 controls the fan 83 to stop rotating. Likewise, it is desirable that the vibrating operation of the vibrating portion 81A is stopped a predetermined time before the printing operation of the image forming apparatus 1 and rotation of the fan 83 are started.

With the vibration motor 812 being driven, the first filter 811 vibrates via the frame 810 (FIG. 5). As a result, the toner attached to especially the lower surface of the first filter 811 falls downward due to the vibration. Thus, according to the present embodiment, the vibration can be reliably propagated to the first filter 811 by the vibration of the frame 810.

Further, the first filter 811 is disposed such that a surface thereof at which the airflow enters faces downward. Therefore, the falling toner is prevented from attaching to the first filter 811 again. As a result, clogging of the first filter 811 is prevented as much as possible, and the toner can be stably collected. Further, as described above, the introducing portion 802T causes the air flowing from the inlet 800 to flow into the lower duct 803 from the side portion of the lower duct 803. Then, the toner having fallen from the first filter 811 due to the vibration of the vibration motor 812 is stored (accumulated) on the bottom portion 80T. Therefore, the toner stored on the bottom portion 80T is prevented as much as possible from blocking the airflow to the lower duct 803.

The arrangement of the toner collecting unit 8 in the image forming apparatus 1 will be described. With reference to FIGS. 1 to 4, the duct fall portion 802 and the duct rise portion 80U of the housing 80 are arranged adjacent to each other in the horizontal direction inside the housing 80. The air flowing from the inlet 800 is temporarily caused to fall in the duct fall portion 802, and thereafter, caused to rise in the duct rise portion 80U. Accordingly, the airflow can be reliably made to be an ascending air current. In addition, since the duct fall portion 802 and the duct rise portion 80U are arranged adjacent to each other in the housing 80, space-saving of the housing 80 is realized.

Further, the sheet feed portion 40 of the image forming apparatus 1 is disposed beneath the developing device 324. The inlet 800 of the toner collecting unit 8 is disposed at substantially the same height as the developing device 324 in the vertical direction. The duct fall portion 802 and the duct rise portion 80U of the toner collecting unit 8 are disposed facing the sheet feed portion 40 in the horizontal direction. Therefore, at the lower side of the developing device 324, the air flowing from the inlet 800 can be reliably made to be an ascending air current by utilizing the height of the sheet feed portion 40 of the image forming apparatus 1.

Next, control of the vibrating operation of the vibrating portion 81A by the vibration control portion 93 will be described. After the printing operation is ended in the image forming apparatus 1, if the vibration control portion 93 executes the vibrating operation of the vibrating portion 81A, a waiting time occurs until execution of the next printing operation. Therefore, the vibrating operation of the vibrating portion 81A is preferably executed after a predetermined number of times of printing operations (printing jobs) have been repeated. However, depending on the usage conditions of the image forming apparatus 1 or the environmental conditions, the amount of scattered toner generated in the developing device 324 is likely to vary. Therefore, if the vibrating operation is executed at constant execution intervals, the first filter 811 might be clogged, or the scattered toner flowing into the collecting duct 7 might block the exhaust air path of the collecting duct 7.

In order to resolve such problems, in the present embodiment, the vibration control portion 93 controls the operation condition of the vibrating operation of the vibrating portion 81A in accordance with at least one of two setting conditions, that is, a first condition relating to the environment inside or around the image forming portion 30, and a second condition relating to the coverage rate of a toner image formed on a sheet.

Figure 8A:
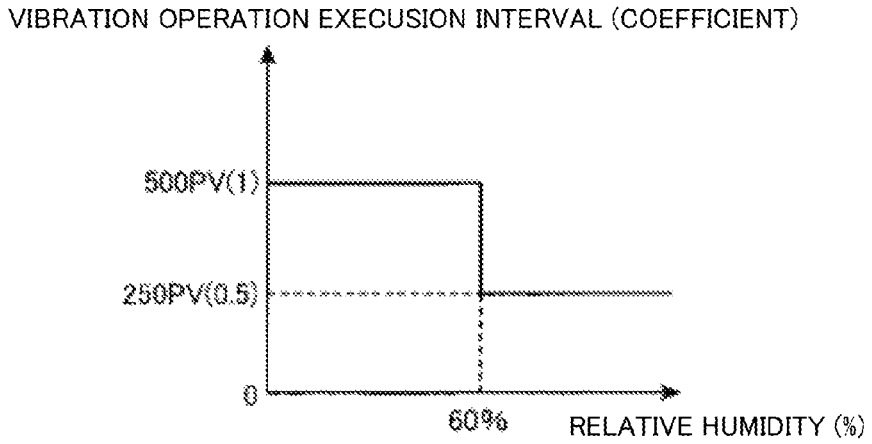
FIGS. 8A and 8B are graphs showing setting conditions for control of a vibrating portion according to the embodiment of the present disclosure.
Figure 8B:
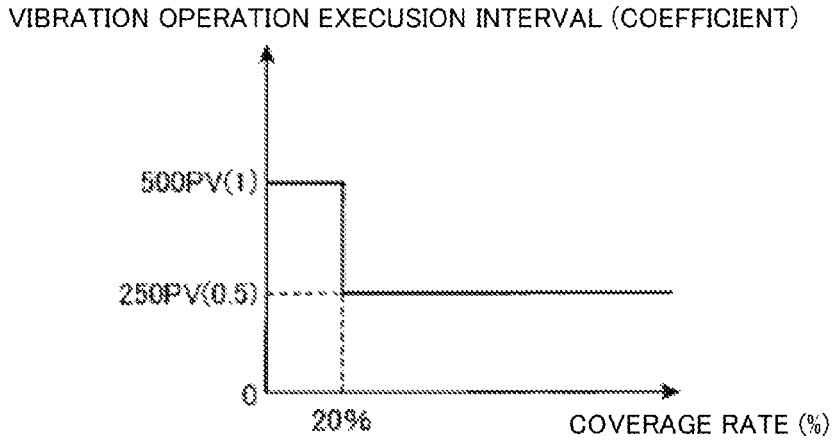

FIG. 8A and FIG. 8B show graphs showing the setting conditions for control of the vibrating operation of the vibrating portion 81A according to the present embodiment. FIG. 8A is a graph showing the execution interval of the vibrating operation of the vibrating portion 81A, which is controlled by the vibration control portion 93 when the relative humidity detected by the environmental sensor 95 varies. Likewise, FIG. 8B is a graph showing the execution interval of the vibrating operation of the vibrating portion 81A, which is controlled by the vibration control portion 93 when the coverage rate of a toner image printed on a sheet varies. The "coverage rate" means the percentage of a print area where a toner image is actually formed to the area of an entire region of a sheet where image formation is possible. Table values corresponding to the graphs of FIGS. 8A and 8B have previously been stored in the storage portion 94. The table values (information) are referred to by the vibration control portion 93.

In the present embodiment, as the execution interval of the vibrating operation of the vibrating portion 81A, that is, the interval between one vibrating operation and another vibrating operation to be executed next to the one vibrating operation, the number of printed sheets, 500, is normally set (ΔT2 in FIG. 7). In other words, when the printing operation for 500 sheets has been executed after the vibrating operation of the vibrating portion 81A was executed at a predetermined timing, the next vibrating operation of the vibrating portion 81A is executed. In the present embodiment, as described above, the vibrating operation of the vibrating portion 81A by the vibration control portion 93 is executed during the non-printing operation time. Therefore, if the image forming apparatus 1 is in the middle of the printing operation (during the job) when the number of sheets printed after the previous vibrating operation has reached 500, the vibrating operation is executed after the printing operation is ended (after the job). It is assumed that the mean coverage rate is 5% in the image forming apparatus 1, and the temperature and the humidity around the image forming portion 30 are normal (24° C./55%). In this case, the vibrating operation being executed at the execution interval corresponding to 500 sheets stably prevents clogging of the first filter 811.

On the other hand, with reference to FIG. 8A, when the humidity around the image forming portion 30, which is detected by the environmental sensor 95, exceeds 60%, the chargeability of the toner inside the developing device 324 is degraded. Therefore, the amount of scattered toner is likely to increase in the developing device 324. In this case, the vibration control portion 93 refers to the table values corresponding to FIG. 8A which are stored in the storage portion 94. Then, the vibration control portion 93 multiplies the normal execution interval, 500 sheets, of the vibrating operation by a coefficient of 0.5, thereby setting the execution interval to 250 sheets. Accordingly, even if a large amount of scattered toner is collected by the first filter 811 of the toner collecting unit 8, clogging of the first filter 811 can be prevented by increasing the frequency of the vibrating operation for the first filter 811 by the vibrating portion 81A. The vibration control portion 93 may set the execution interval to 250 sheets when, in the printing operation after the previous vibrating operation, the printing operation at the humidity of 60% or higher exceeds ½ of the entire printing operation. In this way, the vibration control portion 93 increases the frequency of the vibrating operation by the vibrating portion 81A or the magnitude of the vibration as a countermeasure against the situation where the chargeability of the toner is reduced and thereby the toner becomes more likely to scatter. Therefore, the toner is stably separated from the first filter 811, and clogging of the first filter 811 is prevented.

Likewise, with reference to FIG. 8B, when the coverage rate of a toner image formed on a sheet exceeds 20%, toner consumption in the toner image follows the increased coverage rate. Therefore, a large amount of toner is supplied from the toner supply portion 34 (FIG. 1) to the developing device 324. As a result, replacement of the toner in the developing device 324 is promoted, and the charge amount of each toner is likely to be reduced. As a result, the amount of scattered toner is likely to be increased in the developing device 324. In this case, the vibration control portion 93 refers to the table values corresponding to FIG. 8B which are stored in the storage portion 94. Then, the vibration control portion 93 multiplies the normal execution interval, 500 sheets, of the vibrating operation by a coefficient of 0.5, thereby setting the execution interval to 250 sheets. As for the coverage rate of a toner image to be referred to by the vibration control portion 93, the coverage rate of a toner image formed on one sheet may be referred to, or a mean value of the coverage rates of a plurality of sheets (e.g., 100 sheets) having been printed in the past may be referred to. Further, the coverage rate of a toner image to be referred to by the vibration control portion 93 may be calculated by accumulating the coverage rates for the respective colors of the corresponding developing devices 324, or alternatively, the coverage rate for a single color may be referred to.

Further, when the relative humidity around the image forming portion 30 exceeds 60% in FIG. 8A and the coverage rate of a toner image exceeds 20% in FIG. 8B, occurrence of toner scattering becomes more prominent. In this case, the vibration control portion 93 changes the execution interval of the vibrating operation by the vibrating portion 81A from the interval corresponding to 500 sheets to an interval corresponding to 125 sheets (500 sheets×0.5 (coefficient)×0.5 (coefficient)). That is, the first condition and the second condition (a plurality of setting conditions) are redundantly referred to, and the operation condition (execution interval) of the vibrating operation of the vibrating portion 81A is controlled. In other words, the vibration control portion 93 controls the operation condition of the vibrating operation of the vibrating portion 81A in response to the conditions (the first condition and the second condition) that are likely to cause a reduction in the toner chargeability and toner scattering. Particularly, in the present embodiment, since the scattered toner is directly collected from the inside of the developing device 324, the amount of scattered toner to be collected is likely to vary depending on the chargeability of the toner. Even in this case, the above-mentioned control prevents clogging of the first filter 811, and thereby the collection performance of the toner collecting unit 8 is stably maintained. As the result, the inside and the outside of the image forming apparatus 1 are prevented from being contaminated by the toner.

While the collecting duct 7 (7A), the toner collecting unit 8 (8A), and the image forming apparatus including them according to the embodiment of the present disclosure, have been described, the present disclosure is not limited thereto. For example, the following modifications are also within the scope of the present disclosure.

Figure 9A:
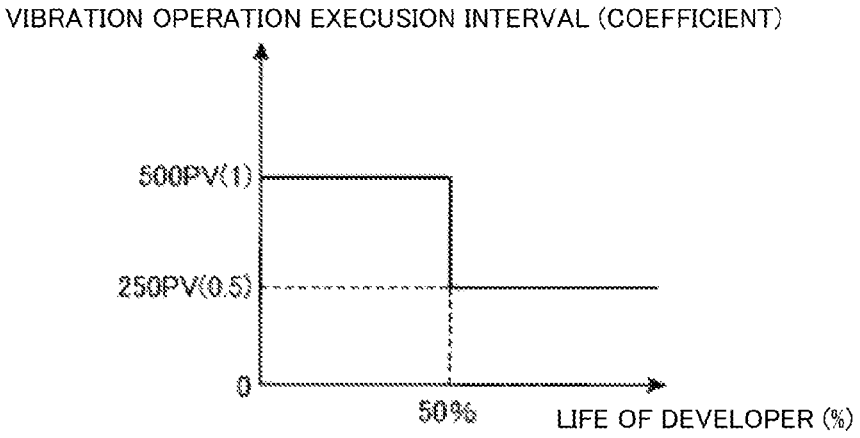
FIGS. 9A and 9B are graphs showing setting conditions for control of a vibrating portion according to a modification of the present disclosure.
Figure 9B:
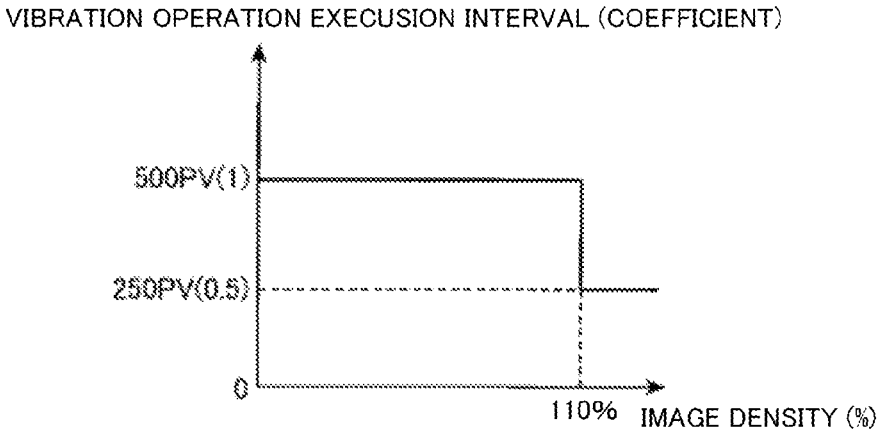

(1) In the above embodiment, as the setting conditions with which the vibration control portion 93 controls the operation condition of the vibrating operation of the vibrating portion 81A, the first condition relating to the environment (temperature/humidity) inside or around the image forming portion 30 and the second condition relating to the coverage rate of a toner image formed on a sheet are adopted. However, the present disclosure is not limited thereto. The vibration control portion 93 may control the operation condition of the vibrating operation of the vibrating portion 81A in accordance with a third condition relating to the number of printed sheets or a fourth condition relating to the density of a toner image. FIG. 9A is a graph showing the relationship between the total number of printed sheets of the image forming apparatus 1 and the execution interval of the vibrating operation of the vibrating portion 81A, based on the life of the developer stored in the developing device 324. Likewise, FIG. 9B is a graph showing the execution interval of the vibrating operation of the vibrating portion 81A, which is controlled by the vibration control portion 93 when the density of the toner image varies. Both are stored in the storage portion 94 and referred to by the vibration control portion 93, as in the above embodiment.

With reference to FIG. 9A, in this modification, the life of the developer stored in the developing device 324 is 600K sheets (600×1000 sheets) in terms of the total number of printed sheets of the image forming apparatus 1. Therefore, on the horizontal axis of FIG. 9A, 50% means that the total number of printed sheets of the image forming apparatus 1 reaches 300K. On the vertical axis of FIG. 9A, when the total number of printed sheets of the image forming apparatus 1 gradually increases from 0 and reaches 300K, the vibration control portion 93 changes the execution interval of the vibrating operation from the interval of 500 sheets to the interval of 250 sheets (500 sheets×0.5 (coefficient)). As a result, clogging of the first filter 811 is prevented even when the chargeability of the toner is reduced with degradation of the developer and thereby the scattered toner increases.

With reference to FIG. 1 and FIG. 9B, the above-mentioned density sensor 35A detects the density of the toner image formed on the intermediate transfer belt 331. When the chargeability of the toner is excessively reduced, an excessive amount of toner is supplied from the developing device 324 to the photosensitive drum 321, and the density of the toner image is increased. When a preset target density of the toner image is 100%, if the density of the toner image detected by the density sensor 35A exceeds 110%, a reduction in the chargeability of the toner is detected as a change in the toner density. In this modification, the target density of 100% corresponds to a state where a toner image of 0.5 mg/cm$^2$ is formed on a sheet, and the image density of 110% corresponds to a state where a toner image of 0.6 mg/cm$^2$ is formed on a sheet. When the density of the toner image detected by the density sensor 35A exceeds 110%, the vibration control portion 93 changes the execution interval of the vibrating operation from the interval of 500 sheets to the interval of 250 sheets (500 sheets×0.5 (coefficient)). Accordingly, clogging of the first filter 811 is prevented even when the chargeability of the toner is reduced and thereby the scattered toner is likely to be increased.

(2) The vibration control portion 93 may control the operation condition of the vibrating operation of the vibrating portion 81A, based on a combination of a plurality of conditions selected from among the first to fourth conditions. For example, when the relative humidity around the image forming portion 30 exceeds 60% in FIG. 8A and the image density of the toner image exceeds 110% in FIG. 9B, occurrence of toner scattering becomes more prominent. Therefore, the vibration control portion 93 changes the execution interval of the vibrating operation of the vibrating portion 81A from the interval of 500 sheets to the interval of 125 sheets (500 sheets×0.5 (coefficient)×0.5 (coefficient)).

(3) Further, in the above embodiment, the vibration control portion 93 controls the execution interval between one vibrating operation and another vibrating operation to be executed next to the one vibrating operation, as the operation condition of the vibrating operation of the vibrating portion 81A. However, the present disclosure is not limited thereto. The vibration control portion 93 may control the magnitude of vibration of the first filter 811 or the execution time of the vibrating operation, in accordance with the first to fourth setting conditions. When the vibration control portion 93 controls at least one of the magnitude of vibration and the execution time, the first filter 811 is stably vibrated under the appropriate operation condition.

The magnitude of vibration of the first filter 811 is controlled by varying the voltage or current applied to the vibration motor 812. By setting the magnitude of vibration of the first filter 811 to be large (by increasing the magnitude of vibration), more toner is separated from the first filter 811 even when a large amount of scattered toner is collected by the toner collecting unit 8. Thereby, clogging of the first filter 811 is prevented.

The execution time of the vibrating operation corresponds to time ΔT1 shown in FIG. 7. By setting the execution time of each vibrating operation to be long (by increasing the execution time), more toner is separated from the first filter 811 even when a large amount of scattered toner is collected by the toner collecting unit 8. Thereby, clogging of the first filter 811 is prevented.

As described above, when, as the first condition, the temperature or the humidity inside or around the image forming portion 30 exceeds a predetermined threshold value, the vibration control portion 93 reduces the execution interval of the vibrating operation or increases the magnitude of vibration of the first filter 811 by the vibrating portion 81A or the execution time of the vibration. Likewise, when, as the second condition, the coverage rate of the toner image exceeds a predetermined threshold value, the vibration control portion 93 reduces the execution interval of the vibrating operation, or increases the magnitude of the vibration or the execution time of the vibration. Further, when, as the third condition, the number of printed sheets exceeds a predetermined threshold value, the vibration control portion 93 reduces the execution interval of the vibrating operation, or increases the magnitude of the vibration or the execution time of the vibration. Furthermore, when, as the fourth condition, the image density of the toner image exceeds a predetermined threshold value, the vibration control portion 93 reduces the execution interval of the vibrating operation, or increases the magnitude of the vibration or the execution time of the vibration.

(4) In the above embodiment, the execution interval of the vibrating operation of the vibrating portion 81A is controlled based on the number of printed sheets. However, the present disclosure is not limited thereto. The vibration control portion 93 may control the execution interval of the vibrating operation, based on the amount of toner consumed in the image forming portion 30. In this case, the toner consumption may be calculated based on the amount of toner supplied from the toner supply portion 34 (FIG. 1) to the developing device 324. Alternatively, the toner consumption may be calculated based on the coverage rate on a sheet. For example, when the relative humidity around the image forming portion 30 exceeds 60% in FIG. 8A and the image density of the toner image exceeds 110% in FIG. 9B, occurrence of toner scattering becomes prominent. Therefore, the vibration control portion 93 changes the execution interval of the vibrating operation of the vibrating portion 81A from the interval corresponding to toner consumption of 500 g to the interval corresponding to toner consumption of 125 g (500 g×0.5 (coefficient)×0.5 (coefficient)). That is, the execution interval of the vibrating operation is set to be shorter in response to the situation where occurrence of toner scattering is likely to increase with the environment around the image forming portion 30 and a reduction in the density even when the toner consumption is small. Thus, the execution interval of the vibrating operation of the vibrating portion 81A can be stably controlled based on the number of printed sheets or the toner consumption.

(5) Further, in the above embodiment, the vibrating portion for vibrating the first filter 811 includes the vibration motor 812. However, the present disclosure is not limited thereto. A cam member, a solenoid, or the like that contacts the first filter 811 or the frame 810 may be disposed as a vibrating portion.

EXAMPLES

Hereinafter, the embodiment of the present disclosure will be described in more detail, taking examples and comparative examples. However, the present disclosure is not limited to the following examples.

Experiment 1

Table 1 shows experimental conditions and evaluation results of Experiment 1. Each experiment was performed by printing 15K sheets, per day, of a toner image having a coverage rate of 10%. In addition, as for the printing environment around the image forming portion 30, the temperature was 24° C., and the relative humidity was 55%. In Example 1, the vibrating operation of the vibrating portion 81A was executed for 15 seconds during each non-printing operation time, every 500 printed sheets.

TABLE 1

| Experiment | Condition | | Execution interval (ΔT2) | Execution time (ΔT1) | Evaluation | Clogging/Inner scattering |
|---|---|---|---|---|---|---|
| Example 1 | Toner collecting unit: provided | Vibration portion: provided | 500 sheets | 15 sec | ○ | No problem up to 600K sheets |
| Comparative Example 1 | Toner collecting unit: provided | Vibration portion: not-provided | — | — | x | Clogging of filter at 250K-th sheet, followed by inner scattering |
| Comparative Example 2 | Toner collecting unit: not-provided | Vibration portion: not-provided | — | — | xx | Inner scattering at 80K-th sheet |

As shown in Table 1, in Example 1 in which the vibrating operation of the present disclosure is applied, toner did not scatter in the image forming apparatus 1 and thus stable printing operation was continued until the number of printed sheets reached 600K, in contrast to Comparative Example 1 and Comparative Example 2.

Experiment 2

Table 2 shows experiment conditions and evaluation results of Experiment 2. In this experiment, as the condition that is likely to cause toner scattering, the coverage rate of a toner image was varied, followed by evaluation. In Table 2, the "toner collection amount" indicates the amount of toner collected in the housing 80 including the bottom portion 80T.

TABLE 2

| Experiment | Environment condition | Coverage rate | Execution interval (ΔT2) | Amplitude | Execution time (ΔT1) | Evaluation | Clogging/Inner-scattering | Toner collection amount |
|---|---|---|---|---|---|---|---|---|
| Example 1 | 24° C./55%RH | 10% | 500 sheets | 0.6 mm | 15 sec | ○ | No problem up to 600K sheets | Collection amount at 600K-th sheet: 7 g |
| Example 2 | 24° C./55%RH | 5% | 500 sheets | 0.6 mm | 15 sec | ○ | No problem up to 600K sheets | Collection amount at 600K-th sheet: 5 g |
| Comparative Example 3 | 24° C./55%RH | 25% | 500 sheets | 0.6 mm | 15 sec | x | Filter clogging at 420K-th sheet | Collection amount at 420K-th sheet: 11 g |
| Example 3 | 24° C./55%RH | 25% | 250 sheets | 0.6 mm | 15 sec | ○ | No problem up to 600K sheets | Collection amount at 600K-th sheet: 16 g |
| Example 4 | 24° C./55%RH | 25% | 500 sheets | 0.6 mm | 30 sec | ○ | No problem up to 600K sheets | Collection amount at 600K-th sheet: 16 g |

In contrast to above Example 1, experiment was performed with the coverage rate of 5% in Example 2, and experiment was performed with the coverage rate of 25% in Examples 3 and 4 and Comparative Example 3. In Example 2, like in Example 1, since the vibrating operation was executed at every 500 sheets, the toner did not scatter in the image forming apparatus 1 and thus stable printing operation was continued until the number of printed sheets reached 600K. On the other hand, in Comparative Example 3, since the coverage rate was increased to 25%, clogging of the first filter 811 occurred at the 420K-th sheet in the vibrating operation executed at the execution interval of 500 sheets. In contract, in Example 3, even when the coverage rate was 25%, since the interval of the vibrating operation was set to 250 sheets, the toner was prevented from scattering in the image forming apparatus 1 until the number of printed sheets reached 600K. In addition, in Example 4, even when the interval of the vibrating operation remained at 500 sheets, since the execution time of each vibrating operation was set to 30 seconds, the toner was prevented from scattering in the image forming apparatus 1 until the number of printed sheets reached 600K. Additionally, in Examples 3 and 4, in response to the high coverage rate (25%), a larger amount of toner (16 g) was reliably collected in the housing 80.

Experiment 3

Table 3 shows experiment conditions and evaluation results of Experiment 3. In this experiment, as the condition that is likely to cause toner scattering, the humidity around the image forming portion 30 and the coverage rate were varied, followed by evaluation. Also in Table 3, the "toner collection amount" indicates the amount of toner collected in the housing 80 including the bottom portion 80T.

TABLE 3

| Experiment | Environment condition | Coverage rate | Execution interval (ΔT2) | Amplitude | Execution time (ΔT1) | Evaluation | Clogging/Inner scattering | Toner collection amount |
|---|---|---|---|---|---|---|---|---|
| Example 1 | 24° C./55%RH | 10% | 500 sheets | 0.6 mm | 15 sec | ○ | No problem up to 600K sheets | Collection amount at 600K-th sheet: 7 g |
| Comparative Example 4 | 28° C./75%RH | 10% | 500 sheets | 0.6 mm | 15 sec | x | Filter clogging at 450K-th sheet | Collection amount at 450K-th sheet: 12 g |
| Example 5 | 28° C./75%RH | 10% | 250 sheets | 0.6 mm | 15 sec | ○ | No problem up to 600K sheets | Collection amount at 600K-th sheet: 18.5 g |
| Example 6 | 28° C./75%RH | 10% | 500 sheets | 0.6 mm | 30 sec | ○ | No problem up to 600K sheets | Collection amount at 600K-th sheet: 18.5 g |
| Example 7 | 28° C./75%RH | 10% | 250 sheets (on and after reaching 300K- | 0.6 mm | 15 sec | ○ | No problem up to 600K sheets | Collection amount at 600K-th sheet: 18.5 g |
| Example 8 | 10° C./20%RH | 10% | 500 sheets | 0.6 mm | 15 sec | ○ | No problem up to 600K sheets | Collection amount at 600K-th sheet: 5.5 g |
| Comparative Example 5 | 28° C./75%RH | 25% | 500 sheets | 0.6 mm | 15 sec | x | Filter clogging at 340K-th sheet | Collection amount at 340K-th sheet: 11 g |
| Example 9 | 28° C./75%RH | 25% | 250 sheets | 0.6 mm | 15 sec | Δ | Filter clogging at 540K-th sheet | Collection amount at 600K-th sheet: 18 g |
| Example 10 | 28° C./75%RH | 25% | 125 sheets | 0.6 mm | 15 sec | ○ | No problem up to 600K sheets | Collection amount at 600K-th sheet: 18 g |
| Example 11 | 28° C./75%RH | 25% | 250 sheets | 0.6 mm | 30 sec | ○ | No problem up to 600K sheets | Collection amount at 600K-th sheet: 18 g |
| Example 12 | 28° C./75%RH | 25% | 500 sheets | 1.2 mm | 7.5 sec | ○ | No problem up to 600K sheets | Collection amount at 600K-th sheet: 18 g |

In Comparative Example 4, in the vibrating operation executed at the execution interval of 500 sheets, clogging of the first filter 811 occurred at the 450K-th sheet due to increase in temperature and humidity. In contrast, in Example 5, even with the above condition of temperature and humidity, since the interval of the vibrating operation was set to 250 sheets, the toner was prevented from scattering in the image forming apparatus 1 until the number of printed sheets reached 600K. Further, in Example 6, even though the interval of the vibrating operation remained at 500 sheets, since the execution time of each vibrating operation was set to 30 seconds, the toner was similarly prevented from scattering in the image forming apparatus 1 until the number of printed sheets reached 600K. Additionally, in Examples 5 and 6, in response to the high temperature/humidity environment (28° C./75%), a larger amount of toner (18.5 g) was reliably collected in the housing 80.

Further, in Example 7, the experiment was performed with the execution interval of the vibrating operation being varied in accordance with change in the number of printed sheets in the image forming apparatus 1, under the high temperature/humidity environment (28° C./75%). That is, until the number of printed sheets reached 300K, the execution interval was set to 500 sheets, and when the number of printed sheets exceeded 300K, the execution interval was set to 250 sheets. Also in this case, the toner was prevented from scattering in the image forming apparatus 1 until the number of printed sheets reached 600K. The toner collection amount in the toner collecting unit 8 changed as follows: 3 g for 0 to 150K sheets; 4 g for 150K to 300K sheets; 5 g for 300K to 450K sheets; and 6.5 g for 450K to 600K sheets. In this way, even when the execution interval was varied, collection of the toner was stably realized. Further, in Example 8, the environment condition of Example 1 was changed and the experiment was performed under the low temperature/humidity environment (10° C./20%). Since the chargeability of the toner was less likely to be reduced under such low temperature/humidity environment, the toner was prevented from scattering in the image forming apparatus 1 until the number of printed sheets reached 600K, as in Example 1.

Further, in Comparative Example 5 and Examples 9 to 12, the experiments were performed with the coverage rate of 25% in addition to the high temperature/humidity environment (28° C./75%). That is, these conditions correspond to a stress condition in which the conditions that are likely to cause toner scattering are combined. With reference to Comparative Example 5, in the vibrating operation performed with the normal execution interval, i.e., 500 sheets, clogging of the first filter 811 occurred when the number of printed sheets reached 340K. On the other hand, in Example 9, in the vibrating operation performed with the execution interval of 250 sheets, clogging of the first filter 811 was prevented until the number of sheets reached 540K which is though less than 600K. Further, in Example 10, in response to the high temperature/humidity environment and the high coverage rate, the execution interval of the vibrating operation was changed from 500 sheets to 125 sheets, and thus the toner was prevented from scattering in the image forming apparatus 1 until the number of printed sheets reached 600K. Further, in Example 11, by combining the vibrating operation execution interval of 250 sheets and the execution time of 30 seconds, the toner was similarly prevented from scattering in the image forming apparatus 1 until the number or printed sheets reached 600K. Moreover, in Example 12, the experiment was performed with the magnitude (amplitude) of vibration of the first filter 811 being changed from 0.6 mm to 1.2 mm in accordance with the above modification. As a result, the toner was prevented from scattering inside the image forming apparatus 1 until the number of printed sheets reached 600K even when the execution time was 7.5 seconds. In addition, in Examples 9 to 12, in response to the high temperature/humidity environment (28° C./75%) and the high coverage rate (25%), a large amount of toner (18 g) was reliably collected in the housing 80. In this way, the vibration control portion 93 controls, as the operation condition of the vibrating operation of the vibrating portion 81A, at least one of the execution interval, the magnitude of vibration of the first filter 811, and the execution time of the vibrating operation, whereby the toner collection performance of the toner collecting unit 8 was stably maintained.

In the above-mentioned present embodiment, the vibration control portion 93 vibrates the vibrating portion 81A, thereby preventing clogging of the first filter 811, and maintaining the exhaust air path of the collecting duct 7. However, the present embodiment is not limited thereto. Any member other than the vibrating portion 81A may be operated as long as clogging of the first filter 811 can be prevented and the exhaust air path of the collecting duct 7 can be maintained. For example, the fan control portion 92 may control the intake operation of the fan 83 in accordance with at least one of the first to fourth setting conditions described above. In other words, when the amount of scattered toner in the developing device 324 is great, the volume of air pressing the scattered toner against the first filter 811 may be varied to facilitate separation of the toner from the first filter 811 by gravity.

Specifically, the fan control portion 92 increases the execution interval of the intake operation, or reduces the volume of air generated by the fan 83, or reduces the execution time of the intake operation, when, as the first condition, the temperature or the humidity inside or around the image forming portion 30 exceeds a predetermined threshold value. Likewise, the fan control portion 92 increases the execution interval of the intake operation, or reduces the volume of air generated by the fan 83, or reduces the execution time of the intake operation when, as the second condition, the coverage rate of the toner image exceeds a predetermined threshold value. Furthermore, the fan control portion 92 increases the execution interval of the intake operation, or reduces the volume of air generated by the fan 83, or reduces the execution time of the intake operation when, as the third condition, the number of printed sheets exceeds a predetermined threshold value. Furthermore, the fan control portion 92 increases the execution interval of the intake operation, or reduces the volume of air generated by the fan 83, or reduces the execution time of the intake operation when, as the fourth condition, the image density of the toner image exceeds a predetermined threshold value.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

an image forming portion configured to execute a printing operation of forming a toner image on a sheet;

a collecting duct into which unnecessary toner generated inside or around the image forming portion flows together with an airflow;

a toner collecting device communicating with the collecting duct, having a path of the airflow formed therein, and configured to collect the toner together with the airflow, the toner collecting device including a filter configured to collect the toner and let the airflow pass therethrough, an airflow generating portion disposed downstream of the filter in the path of the airflow, and configured to execute an intake operation of generating the airflow, and a vibrating portion configured to execute a vibrating operation of vibrating the filter; and a first control portion configured to control an operation condition of the vibrating operation, wherein the first control portion reduces the execution interval between vibrations or increases the magnitude of vibration or the execution time of the vibration when an image density of the toner image that is detected by a density sensor exceeds a predetermined threshold value.

2. The image forming apparatus according to claim 1, wherein the execution interval is set based on the number of printed sheets or the amount of the toner consumed in the image forming portion.

3. The image forming apparatus according to claim 1, further comprising:

a second control portion configured to control the intake operation of the airflow generating portion, wherein the first control portion causes the vibrating portion to execute the vibrating operation during a non-printing operation time when the printing operation is not executed in the image forming portion, and causes the vibrating portion to stop the vibrating operation during a printing operation time when the printing operation is executed, and the second control portion causes the airflow generating portion to execute the intake operation during the printing operation time, and causes, during the non-printing operation time, the airflow generating portion to stop the intake operation or reduce the volume of the airflow as compared to the printing operation time.

4. The image forming apparatus according to claim 1, wherein the first control portion reduces the execution interval or increases the magnitude of vibration or the execution time of the vibration when a temperature or a humidity inside or around the image forming portion exceeds a predetermined threshold value, as detected by the environmental sensor.

5. The image forming apparatus according to claim 1, wherein the first control portion reduces the execution interval or increases the magnitude of vibration or the execution time of the vibration when the coverage rate of the toner image exceeds a predetermined threshold value.

6. The image forming apparatus according to claim 1, further comprising:

a second control portion configured to control the intake operation of the airflow generating portion, wherein the first control portion causes the vibrating portion to execute the vibrating operation during a non-printing operation time when the printing operation is not executed in the image forming portion, and causes the vibrating portion to stop the vibrating operation during a printing operation time when the printing operation is executed, and the second control portion causes the airflow generating portion to execute the intake operation during the printing operation time, and causes, during the non-printing operation time, the airflow generating portion to stop the intake operation or reduce the volume of the airflow as compared to the printing operation time.

7. The image forming apparatus according to claim 1, wherein the toner collecting device includes:

a housing having a path of airflow formed therein, and supporting the filter and the airflow generating portion;

an inlet opened in the housing and communicating with the collecting duct, through which the toner flows into the housing together with the airflow;

a guiding duct portion disposed between the inlet and a fan in the path of the airflow, and configured to guide the airflow upward from a lower portion thereof; and a storage portion disposed beneath the guiding duct portion, in which the toner is stored, the filter is disposed above the guiding duct portion such that a surface thereof on which the airflow enters faces downward, and the toner falling from the filter due to the vibration is accumulated in the storage portion by gravity.

8. The image forming apparatus according to claim 1, wherein the image forming portion includes:

an image carrier having a surface on which an electrostatic latent image is formed, and configured to carry the toner image; and a developing device having toner stored therein, and configured to supply the toner to the image carrier, and the collecting duct communicates with the developing device, and collects the unnecessary toner from the inside of the developing device.

* * * * *